US008033582B2

(12) United States Patent
Sawatani et al.

(10) Patent No.: US 8,033,582 B2
(45) Date of Patent: Oct. 11, 2011

(54) SIDE LOCK DEVICE

(75) Inventors: Seiji Sawatani, Kanagawa (JP); Hiroaki Ichioka, Kanagawa (JP)

(73) Assignee: Piolax, Inc., Yokohama-Shi, Kanagawa (JP)

( * ) Notice: Subject to any disclaimer, the term of this patent is extended or adjusted under 35 U.S.C. 154(b) by 0 days.

(21) Appl. No.: 10/446,717

(22) Filed: May 29, 2003

(65) Prior Publication Data

US 2004/0017088 A1 Jan. 29, 2004

(30) Foreign Application Priority Data

Jun. 3, 2002 (JP) ..... P. 2002-161139

(51) Int. Cl.
*E05C 1/00* (2006.01)

(52) U.S. Cl. ..... 292/33; 292/37; 292/140; 292/159; 292/DIG. 38

(58) Field of Classification Search ..... 292/32–34, 292/37–38, 40, 141, 158–159, 161, 140, 292/170, 27, 29, 46, 52, 42, 137, 145, 146, 292/150, 171, 175, DIG. 20, DIG. 38, DIG. 47
See application file for complete search history.

(56) References Cited

U.S. PATENT DOCUMENTS

| | | | | | |
|---|---|---|---|---|---|
| 1,670,277 | A | * | 5/1928 | Albach | 292/37 |
| 1,689,804 | A | * | 10/1928 | Segal | 70/117 |
| 1,977,853 | A | * | 10/1934 | Kemp | 70/118 |
| 3,596,952 | A | * | 8/1971 | Hinkle et al. | 292/27 |
| 4,168,616 | A | * | 9/1979 | Goldman | 292/37 |
| 4,639,021 | A | * | 1/1987 | Hope | 292/7 |
| 4,781,407 | A | | 11/1988 | Rauchhaus | |
| 4,791,756 | A | * | 12/1988 | Simpson | 49/175 |
| 5,131,699 | A | * | 7/1992 | Frestadius | 292/40 |
| 5,219,195 | A | * | 6/1993 | Lawrence | 292/336.3 |
| 5,484,178 | A | * | 1/1996 | Sandhu et al. | 292/173 |
| 5,509,700 | A | * | 4/1996 | Kennedy, Jr. | 292/3 |
| 5,688,000 | A | * | 11/1997 | Dolman | 292/34 |
| 5,782,510 | A | * | 7/1998 | Gass | 292/165 |
| 5,975,592 | A | * | 11/1999 | Lin | 292/37 |
| 6,094,949 | A | * | 8/2000 | Lagerberg et al. | 292/37 |
| 6,152,512 | A | * | 11/2000 | Brown et al. | 296/37.12 |

(Continued)

FOREIGN PATENT DOCUMENTS

DE 3616020 5/1986

(Continued)

OTHER PUBLICATIONS

Korean Office Action dated Aug. 14, 2006 with English Translation.

(Continued)

*Primary Examiner* — Carlos Lugo
*Assistant Examiner* — Christopher Boswell
(74) *Attorney, Agent, or Firm* — McGinn IP Law Group, PLLC

(57) ABSTRACT

A side rock device attaches a first member to a second member to be openable. The side rock device includes a pair of lock arms, a housing which holds the lock arms movably, a slider defining inclining holes which engage with the lock arms and urge the lock arms to protrude and retract, the slider disposed in the housing, and an elastic member which elastically urges the slider toward a predetermined direction. When the slider is operated against an elastic urging force of the elastic member, the lock arms are retracted.

20 Claims, 13 Drawing Sheets

U.S. PATENT DOCUMENTS

| | | | | |
|---|---|---|---|---|
| 6,527,307 | B2 * | 3/2003 | Welsh et al. | 292/70 |
| 6,669,243 | B2 * | 12/2003 | Katoh et al. | 292/34 |

FOREIGN PATENT DOCUMENTS

| | | | |
|---|---|---|---|
| DE | 198 31 727 | A1 | 1/2000 |
| DE | 201 02 170 | U1 | 11/2001 |
| DE | 100 36 945 | A1 | 2/2002 |
| EP | 0 850 342 | B1 | 4/2001 |
| JP | 02-33755 | | 3/1990 |
| JP | 09-315197 | | 12/1997 |
| WO | WO 95/27115 | | 10/1995 |

OTHER PUBLICATIONS

German Office Action dated Mar. 1, 2007 with English translation.

* cited by examiner

SIDE LOCK DEVICE

The present disclosure relates to the subject matter contained in Japanese Patent Application No. 2002-161139 filed on Jun. 3, 2003, which is incorporated herein by reference in its entirety.

BACKGROUND OF THE INVENTION

1. Field of the Invention

The present invention relates to a side lock device for locking a glove box itself, which is attached onto the instrument panel side of a vehicle so that the glove box can be opened and closed, or for locking an independent lid of the glove box.

2. Description of the Related Art

EP0850342B1 and WO095/27115 disclose a side lock device of this kind.

Essentially, the conventional side lock device adopts a rotary system in which a glove box itself or an independent lid of the glove box is locked onto the instrument panel side while the glove box can be opened and closed.

Therefore, in the conventional side lock device, it is necessary to provide a pair of right and left lock arms extending from the rotary center to both sides. Accordingly, compared with the single lock, the size and volume of the rotary body connecting the lock arms doubles. Therefore, the size and volume of the device itself is increased.

SUMMARY OF THE INVENTION

The present invention is accomplished to effectively solve the above problems of the conventional side lock device.

According to a first aspect of the invention, a side rock device attaches a first member to a second member to be openable. The side rock device includes a pair of lock arms, a housing, a slider and an elastic member. The housing holds the lock arms movably. The slider defines inclining holes, which engage with the lock arms and urge the lock arms to protrude and retract the lock arms. The slider is disposed in the housing. Then elastic member elastically urges the slider toward a predetermined direction. When the slider is operated against an elastic urging force of the elastic member, the lock arms are retracted.

According to a second aspect of the invention, in the first aspect, the holes engage with protrusions of the lock arms and form a reverse-V shape. Opening are formed on side surfaces of the slider to continue to outer ends of the holes, respectively. The openings open during a process of assembling the slider into the housing. The openings close when the slider has been assembled into the housing.

According to a third aspect of the invention, in the second aspect, parallel portions are formed at the outer ends of the holes, respectively, to be parallel to a moving direction of the slider. Each of side surfaces of the parallel portions face to each of openings.

According to a fourth aspect of the invention, in the third aspect, each of lower walls of the parallel portions is perpendicular to the moving direction of the slider or incline in a direction opposite to inclination direction of the reverse-V shape.

According to a fifth aspect of the invention, in the first aspect, the side lock device further includes an operation lever, which operates the slider. The operation lever includes a fulcrum portion, an operation portion, and a pushing pawl. The fulcrum portion is axially supported by the housing so that the operation lever is swingable. The operation portion swings the operation lever. The pushing pawl moves the slider against the elastic urging force. The slider has an evagination portion evaginating upward and abut against the pushing pawl.

According to a sixth aspect of the invention, in the second aspect, turning portions to which the protrusions of the lock arms are fitted are formed at inner ends of the holes, respectively.

According to a seventh aspect of the invention, in the sixth aspect, each of turning portions includes a perpendicular portion, which is perpendicular to a moving direction of the slider.

In the first aspect, the size and volume of the side lock device can be reduced in comparison with those of the conventional rotary system in which the rotary body is rotated.

In the second aspect the opening are formed on side surfaces of the slider to continue to outer ends of the holes, respectively. The openings open during a process of assembling the slider into the housing. The openings close when the slider has been assembled into the housing. Therefore, the slider can be easily assembled to the housing together with the lock arm. Once the slider has been assembled to the housing together with the lock arm, there is no possibility that the lock arm is disengaged therefrom.

In the third aspect, parallel portions are formed at the outer ends of the holes, respectively. Therefore, even when the protrusion of the lock arm is strongly pushed into the opening of each hole, the protrusion of the lock arm collides with the parallel portion and stops on the slider side. As a result, the slider can be easily assembled to the housing in the above condition.

In the fourth aspect, each of lower walls of the parallel portions is perpendicular to the moving direction of the slider or incline in a direction opposite to inclination direction of the reverse-V shape. Therefore, even when the stopper portion for regulating a movement of the slider is damaged, it is possible to prevent the slider from jumping out from the housing. Furthermore, the lock arm can not be easily disengaged.

In the fifth aspect, the slider has an evagination portion evaginating upward and abut against the pushing pawl. Therefore, it is possible to positively move the slider resisting an elastically pushing force while the mechanical strength of the abutment portion therebetween is being increased.

In the sixth aspect, the turning portions are formed at inner ends of the holes, respectively. Therefore, when the protrusion of the lock arm is engaged with the turning portion, it is possible to maintain a state in which each lock arm is retracted. Accordingly, the side lock device itself can be easily assembled to the opening and closing body, and the profile can be made compact.

In the seventh aspect, each of turning portions includes a perpendicular portion, which is perpendicular to the moving direction of the slider. Therefore, it is possible to retract the lock arm more than the normally use range of the operation lever 4. Accordingly, the side lock device itself can be more easily assembled to the opening and closing body, and the profile can be made compact.

DETAILED DESCRIPTION OF THE PREFERRED EMBODIMENTS

Figure 1:
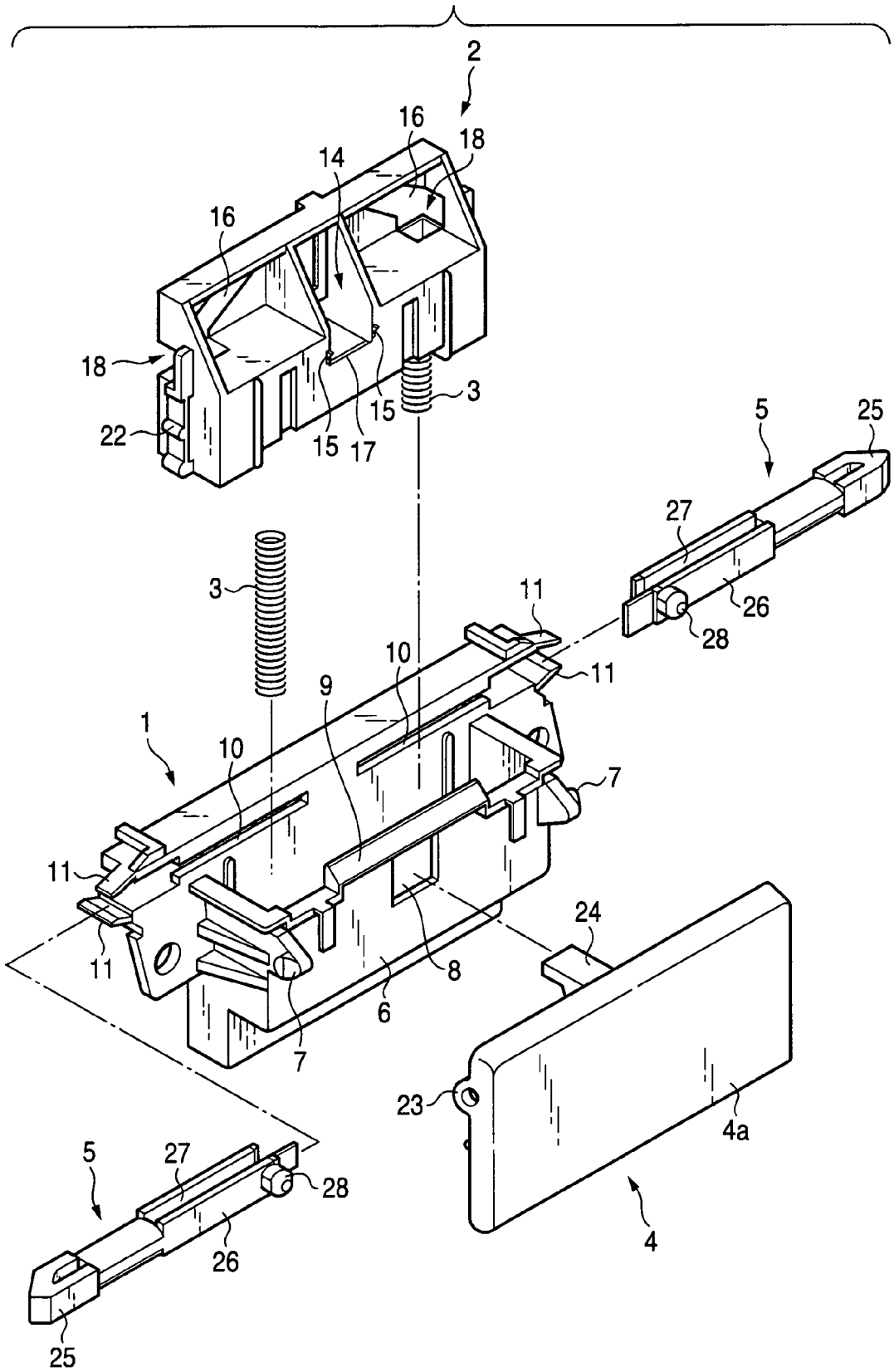
FIG. 1 is an exploded perspective view showing a side lock device of the first embodiment of the present invention.

Referring to the drawings, preferred embodiments of the present invention will be described in detail as follows. An object of the side lock device of the first embodiment is the glove box itself attached to the instrument panel of an automobile while the glove box is capable of being opened and closed. Alternatively, an object of the side lock device of the first embodiment is an independent lid of the glove box. The characteristic of this embodiment is the constitution described below.

As shown in FIG. 1, the side lock device of the first embodiment includes: a housing 1 fixed to the glove box itself or the independent lid; a slider 2 movably held in the housing 1; two compression springs 3 for elastically pushing the slider 2 upward in the housing 1; an operation lever 4 for moving the slider 2 downward while resisting the elastically pushing force of the compression springs 3; and a pair of right and left lock arms 5 which is movably held on the housing 1 side and protruded to engage with a lock hole formed on the instrument panel.

Figure 2A:
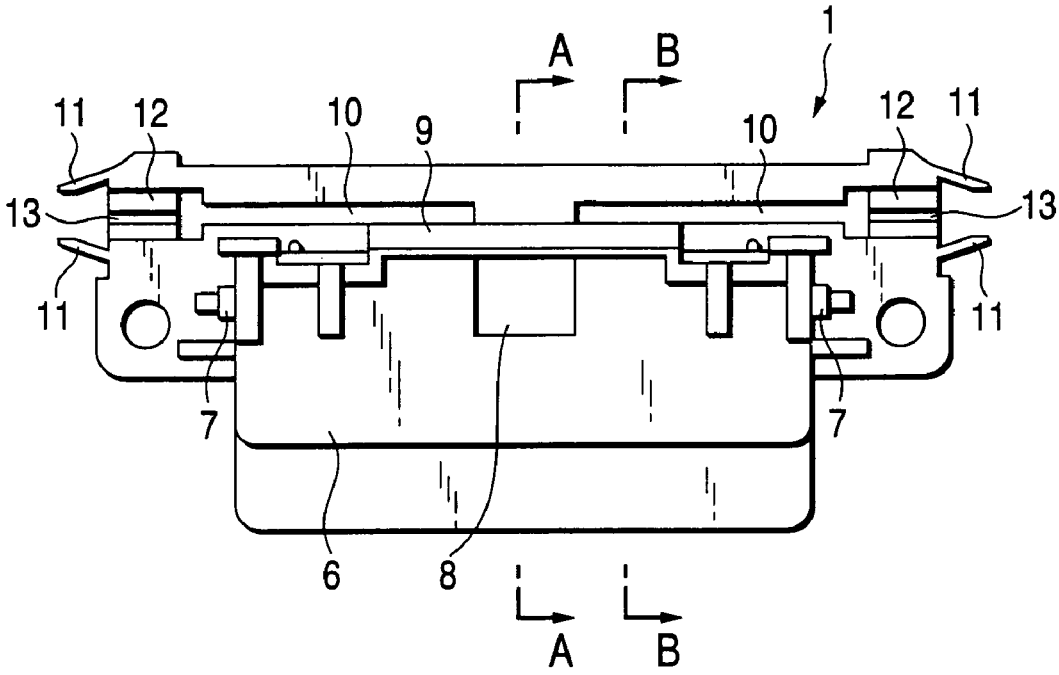
FIG. 2A is a front view of the housing.
Figure 2B:
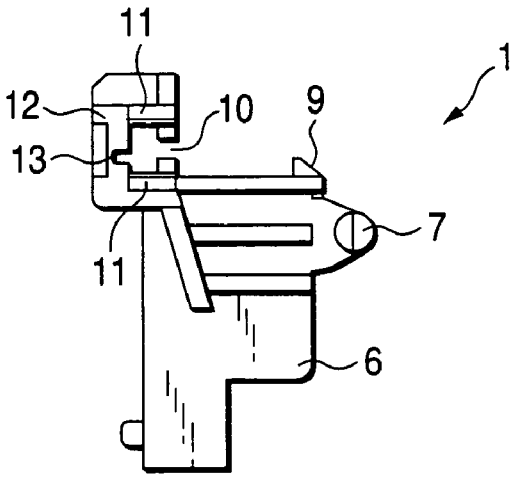
FIG. 2B is a side view of the housing.
Figure 3A:
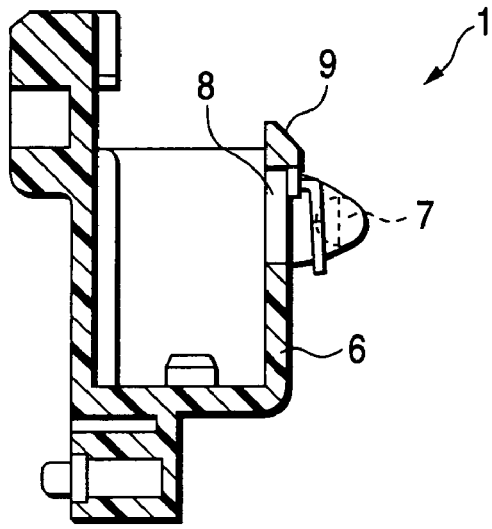
FIG. 3A is a sectional view taken on line A-A in FIG. 2A.
Figure 3B:
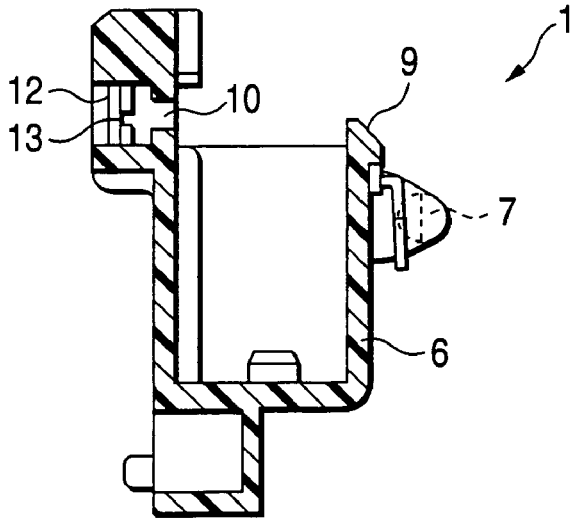
FIG. 3B is a sectional view taken on line B-B in FIG. 2A.

As shown in FIGS. 2 and 3, the housing 1 includes: a base body 6, the upper face side of which is open, in which the slider 2 is movably accommodated so that the slider 2 can be moved upward and downward; a pair of shafts 7 arranged on both sides of the front face of the base body 6, engaged with a bearing 23 of the operation lever 4 described later; a window portion 8 formed at the center on the front face of the base body 6, into which a pushing pawl 24 of the operation lever 4 is inserted; and an oscillation stopper wall 9 of the operation lever 4, arranged on the upper edge side of the window 8.

In addition to that, the housing 1 further includes a pair of holding grooves 10, elastic pieces 11, and a recess portion 13. The pair of holding grooves 10 movably hold the pair of right and left lock arms 5 and are arranged on the rear face side of the base body 6 in the upper width direction. The elastic pieces 11 are formed on upper and lower edges of each of holding grooves. The elastic pieces 11 guide movement of the lock arms to suppress the occurrence of rattling of the lock arm 5. The recess portion 13 is engaged with a protrusion 29 of the lock arm 5 described later and is formed on a wall face 12 provided at the rear of the opening of each holding groove 10. This recess 13 is formed in such a manner that the position of the recess 13 is offset from the center in the height direction because of a relation between the recess 13 and the lock arms 5 described later, which are symmetrical with respect to right and left.

Figure 4A:
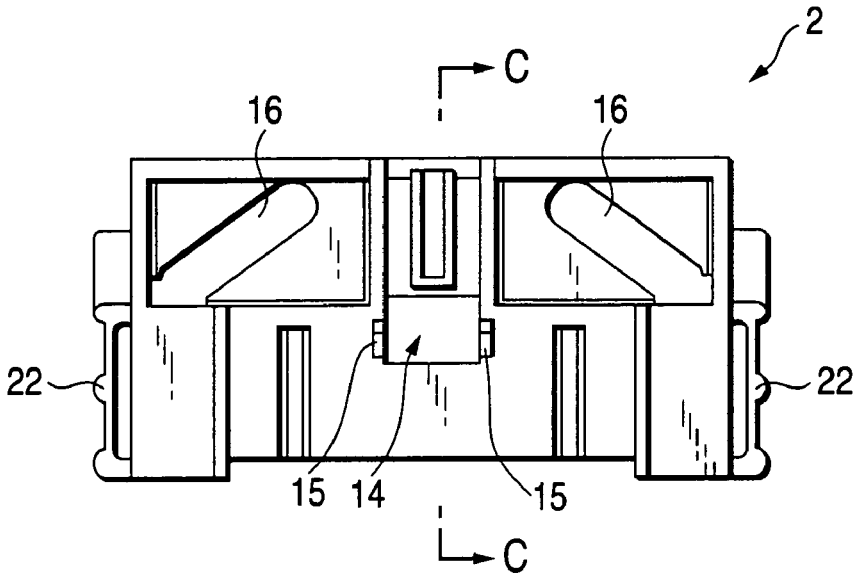
FIG. 4A is a front view of the slider.
Figure 4B:
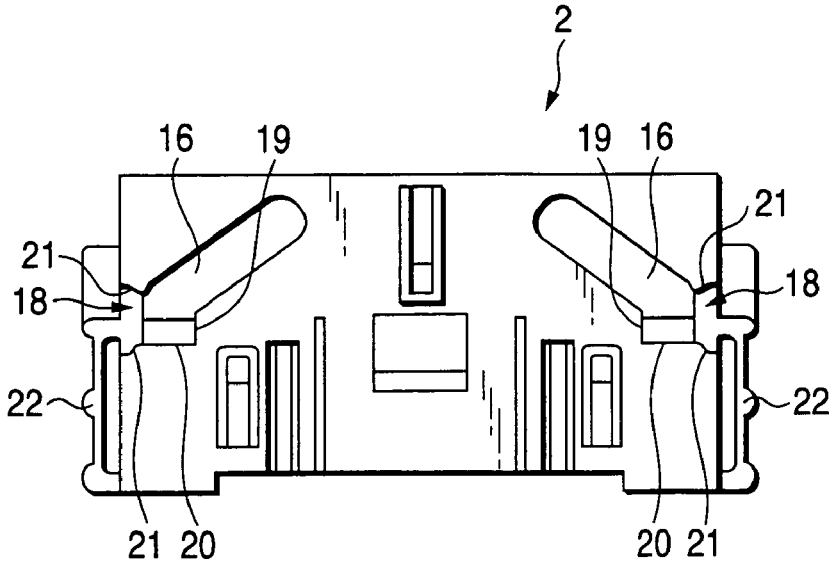
FIG. 4B is a rear view of the slider.
Figure 5A:
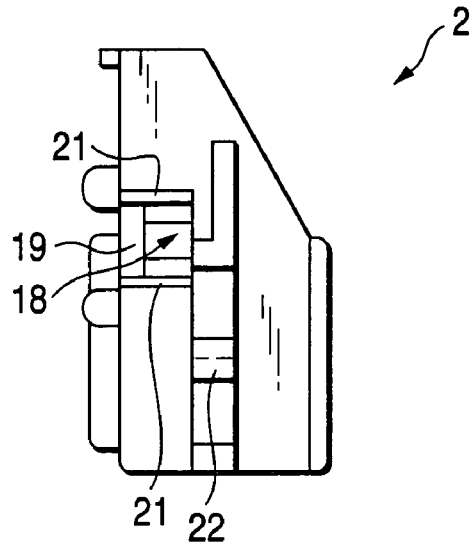
FIG. 5A is a side view of the slider.
Figure 5B:
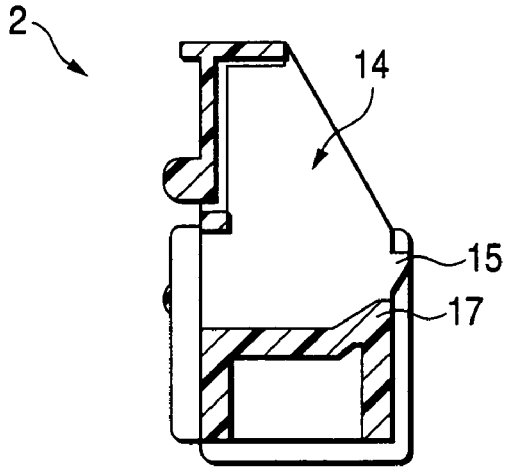
FIG. 5B is a sectional view taken on line C-C in FIG. 4A.

As shown in FIGS. 4 and 5, the slider 2 is formed to have a size so that the slider 2 can be accommodated in the base body 6 of the housing 1. The slider 2 includes a hollow 14, a pair of stopper protrusions 15, and a pair of long cam holes 16. The hollow 14 faces the pushing pawl 24 of the operation lever 4. The pair of stopper protrusions 15 is formed on both sides of the lower portion of the hollow 14 and prevents the slider 2 itself from detaching when the stopper protrusions 15 enter the window 8 on the housing 1 side. The pair of the long cam holes 16 are formed to have a inclining reverse-V-shape on both side portions of the slider 2. In this specification, the reverse-V-shape refers to a shape of a Japanese character " ∧ " and, for example, indicates the entire shape of the two long cam holes 16 shown in FIG. 4. The reverse-V-shape is formed of two liner portions, which open downward. The two linear portions are symmetric each other and have a vertical axis as an axis of symmetry. Upper ends of the linear portions don't intersect with each other and are a little distant from each other. The long cam holes 16 are engaged with the pins 28 of the lock arm 5 so that the pins 28 of the lock arm 5 is urged to protrude and retract from the housing 1. A bottom face edge of the hollow 14 coming into contact with the pushing pawl 24 of the operation lever 4 is evaginated upward as shown in the drawing so that the pushing operation can be positively performed while the mechanical strength is being enhanced.

Each of outer ends of the pair of long cam holes 16 having the reverse-V-shape open (opening 18) to the side surface of the slider 2. At a position in the process of assembling the slider 2 to the base body 6 of the housing 1, the opening 18 is kept open. At a position where the slider 2 is assembled to the housing 1, the opening 18 is kept closed. A parallel portion 19, which is parallel to a moving direction of the slider 2, is formed on the outer end side of the long cam hole 16. A side surface forming an edge of the parallel portion 19 is opposed to the opening 18. A lower end wall 20 of the parallel portion 19 is perpendicular to the moving direction of the slider 2 or inclined to a direction opposite to a reverse-V-shape so that the lock arm 5 can be prevented from detaching. In this connection, an edge of the opening 18 is chamfered (a chamfered portion 21) so that a pin 28 of the lock arm 5 is easily inserted. Reference numeral 22 in the drawing denotes a portion for preventing the occurrence of rattling.

Figure 6A:
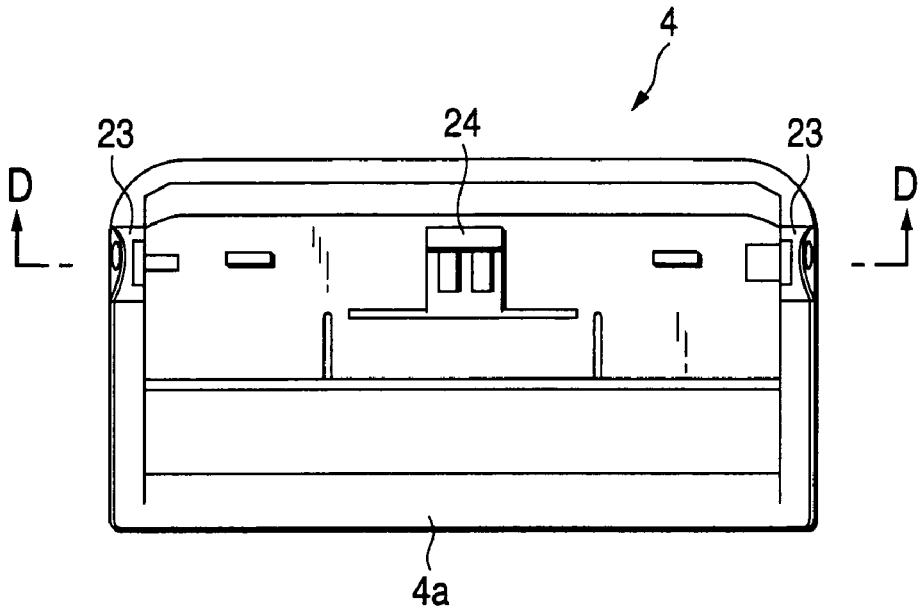
FIG. 6A is a rear view of the operation lever.
Figure 6B:
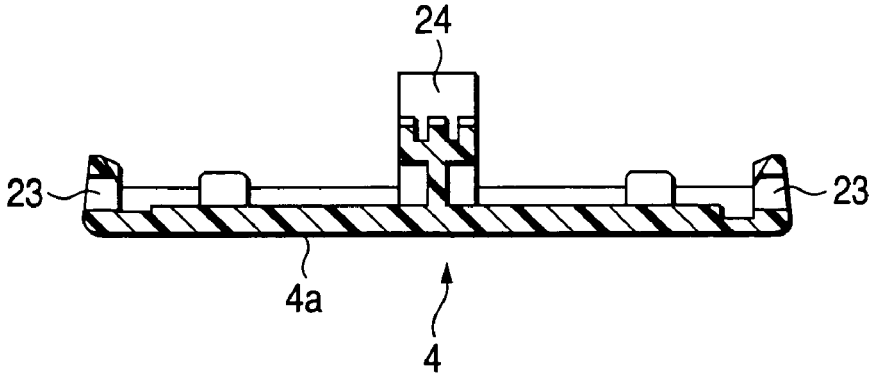
FIG. 6B is a sectional view taken on line D-D in FIG. 6A.

As shown in FIG. 6, the operation lever 4 is formed in a plain plate like shape. The operation lever 4 includes the bearing portions 23 on both sides thereof and the pushing pawl 24 on the rear face side thereof. The shafts 7 of the housing 1 are engaged with the bearing portions 23, respectively so that the operation lever 4 is axially supported on the side of the housing 1 swingably with the engaged portion serving as a fulcrum. The pushing pawl 24 faces the inside of the hollow 14 of the slider 2 to push the bottom evaginating portion 17. When the operation lever 4 is operated to swing, the pushing pawl 24 moves the slider 2 downward against the pushing force of the compression coil spring 3.

Figure 7A:
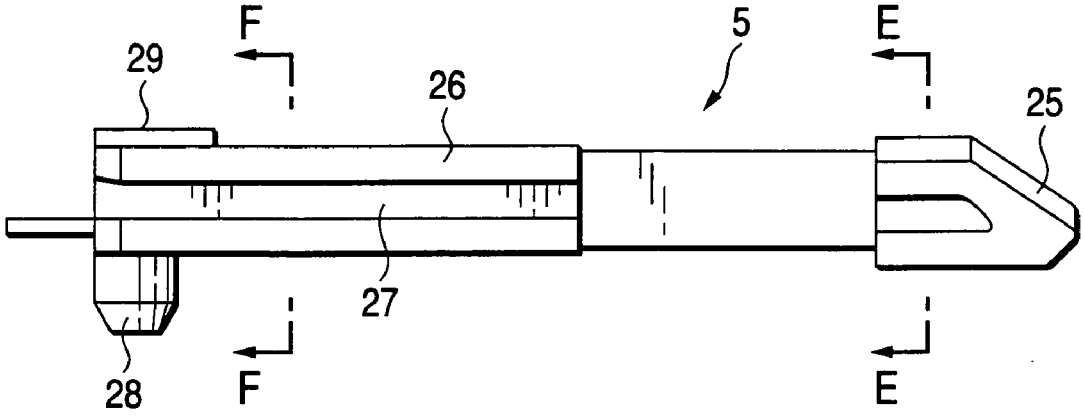
FIG. 7A is a plan view of the lock arm.
Figure 7B:
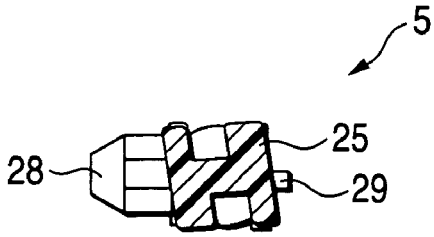
FIG. 7B is a sectional view taken on line E-E in FIG. 7A.
Figure 7C:
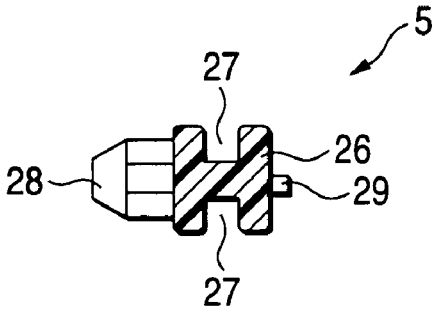
FIG. 7C is a sectional view taken on line F-F o in FIG. 7A.

The pair of lock arms 5 are formed symmetrically to each other. As shown in FIG. 7, each lock arm 5 essentially includes a forward end portion 25, which protrudes to engage with the lock hole formed on the side of the instrument panel, and a rear end portion 26 held by the holding groove 10 of the housing 1. The rear end portion 26 includes slide grooves 27 formed on the both sides thereof opposed to each other, a protruding pin 28 formed on a front face side thereof, and a protrusion 29 formed on a back face side thereof. The slide grooves 27 are engaged with the upper and lower edges of the holding grooves 10. The pin 28 is engaged with the long cam hole 16 having the reverse-V-shape. The protrusion 29 is engaged with the recess 13 formed on the wall face 12 at the rear of the holding groove 10. The protrusions 29 of the lock arms 5 are positioned to be symmetric each other. On each side, the forward end portion 25 is inclined by a predetermined angle with respect to the rear end portion 26. Accordingly, since the protrusion 29 engaging with the recess 13 is positioned being offset from the center in the height direction, it is possible to effectively prevent the pair of right and left lock arms 5 from being erroneously assembled.

Figure 8:
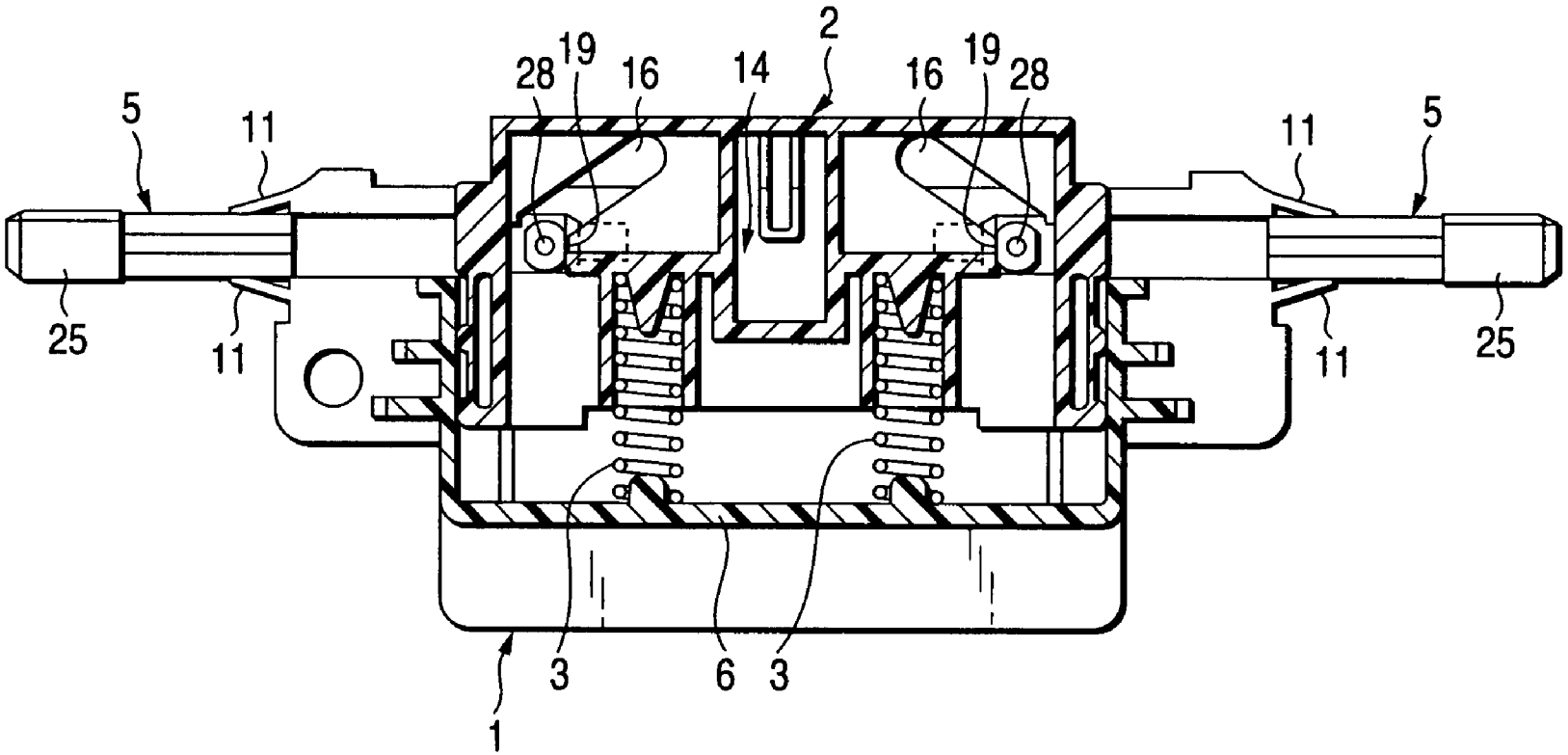
FIG. 8 is a partially cutout front view showing a state in which the pin of the lock arm is inserted into the outer end opening of the long cam hole.
Figure 9:
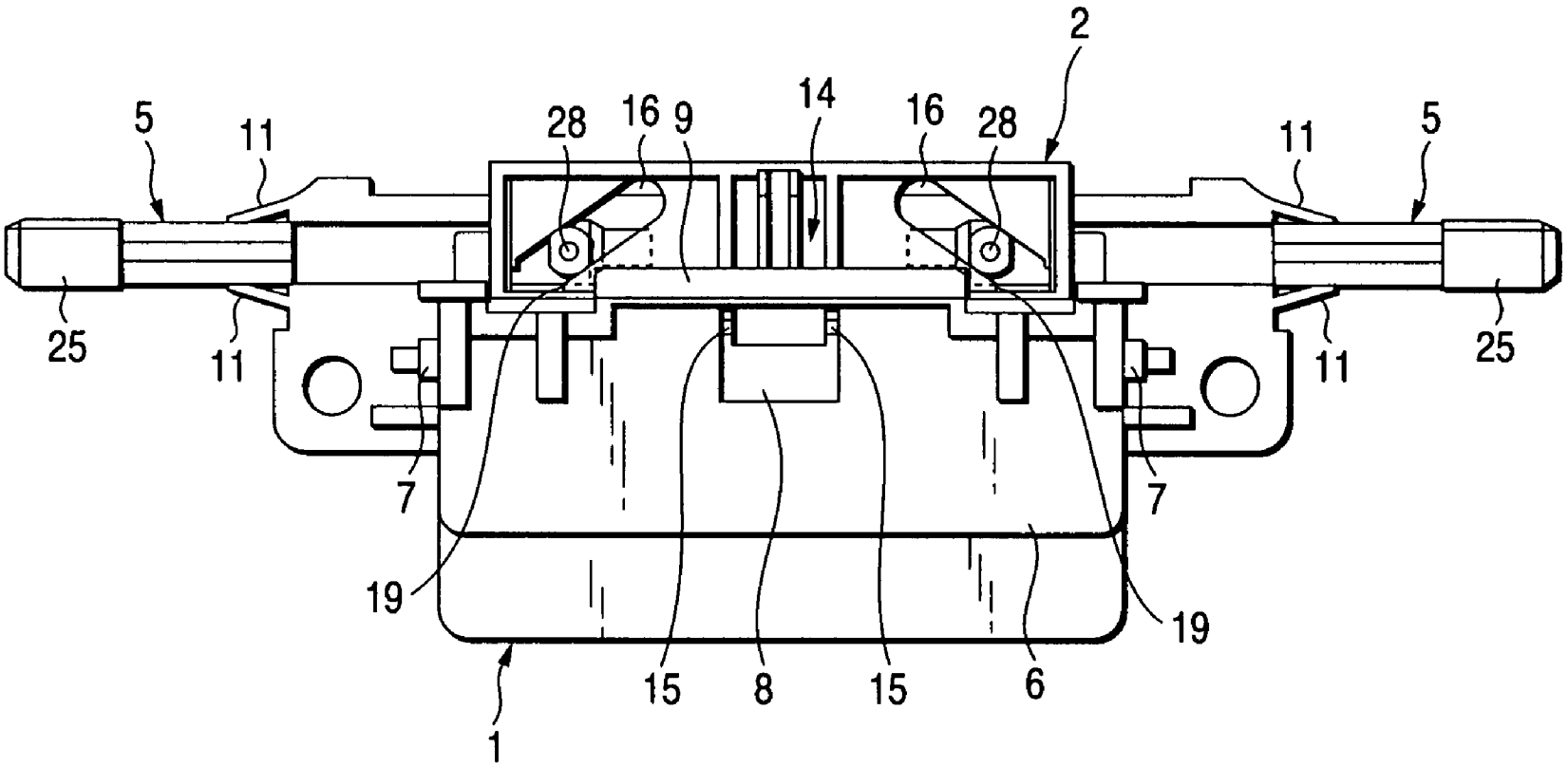
FIG. 9 is a front view showing a state in which the slider is assembled into the housing together with the lock arm.

The thus composed side lock device is assembled as follows. Two compression springs 3 are attached to the receiving portion formed on the bottom face of the base body 6 of the housing 1. Then, when the lower end portion side of the slider 2 is a little inserted inside the base body 6, the holding groove 10 and the outer end opening 18 of the long cam hole 16 match each other. Under this condition, the pair of right and left lock arms 5, which are symmetrical to each other, are pushed into the corresponding grooves 10. Then, as shown in FIG. 8, after the pin 28 of each lock arm 5 is made to collide with the parallel portion 19 of the long cam hole 16, the slider 2 is completely inserted inside the base body 6 as it is. Then, as shown in FIG. 9, the stopper protrusion 15 on the slider 2 side enters the window 8 of the base body 6 and comes into contact with an upper edge of the window 8. Due to the foregoing, the slider 2 can be movably supported on the housing 1 side without detaching.

In this case, under the condition that the slider 2 is a little inserted into the base body 6 of the housing 1, the outer end opening 18 of each long cam hole 16 is open. Therefore, the pin 28 of the lock arm 5 is allowed to be pushed into the long cam hole 16, and the pin 28 can be pushed until it collides with the parallel portion 19 of the long cam hole 16. Accordingly, assembling can be easily performed. Further, after the assembling has been once completed, the outer end opening 18 is closed by the housing 1 even when the slider 2 is located at any position. Therefore, the pair of right and left lock arms 5, which are symmetrical with respect to right and left, are not disengaged from the holding grooves 10.

In the constitution of this embodiment, the slider 2 is moved upward and downward in the base body 6 of the housing 1. Therefore, the slider 2 is moved along the front face of the glove box and/or the front face of the lid. Accordingly, the size and volume of the side lock device itself can be sufficiently reduced.

Figure 10:
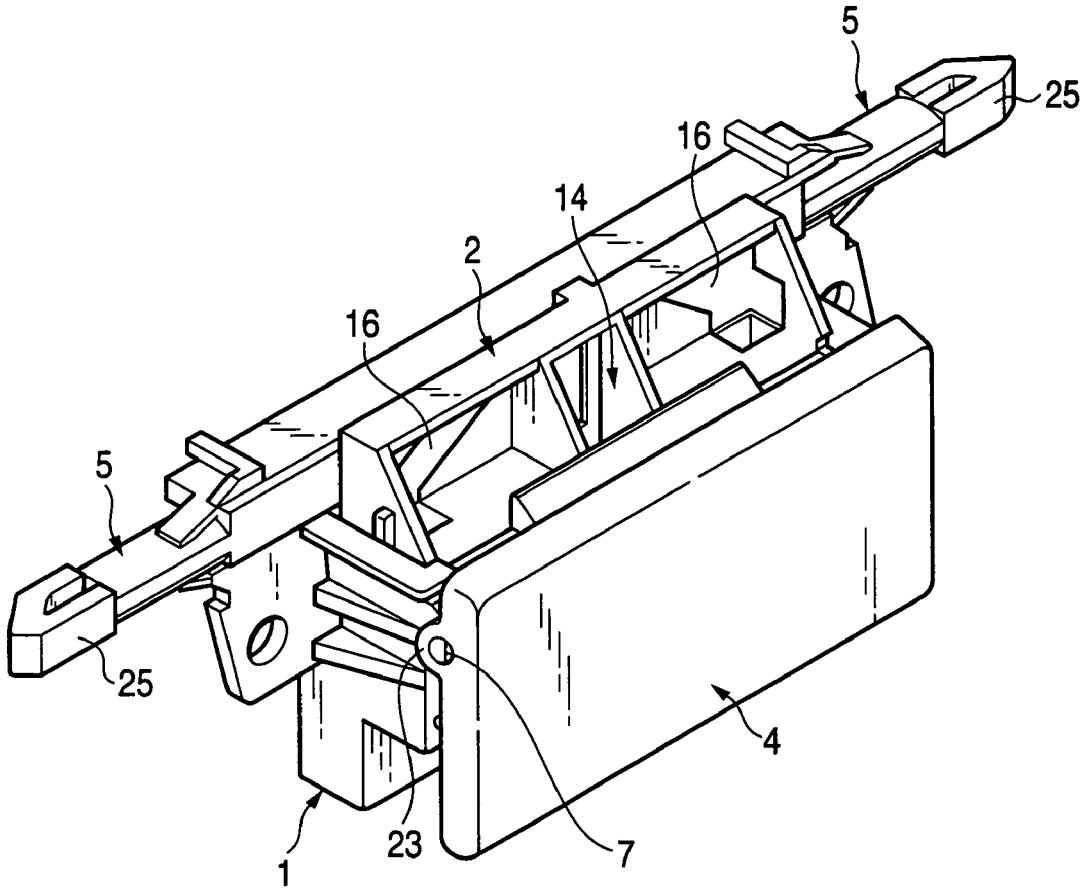
FIG. 10 is a perspective view showing a complete assembling state in which the operation lever is pivotally supported on the housing side.

Accordingly, after that, when the shaft 7 of the housing 1 is engaged with the bearing 23 of the operation lever 4, as shown in FIG. 10, the operation lever 4 is supported by the housing 1 being capable of oscillating. In this case, the pushing pawl 24 of the operation lever 4 faces the hollow 14 of the slider 2 through the window 8, and the pins 28 of the pair of right and left lock arms 5 are located on the outer end side of the inclined long cam hole 16. Therefore, the lock arm 5 is set being protruded to the side.

Figure 11A:
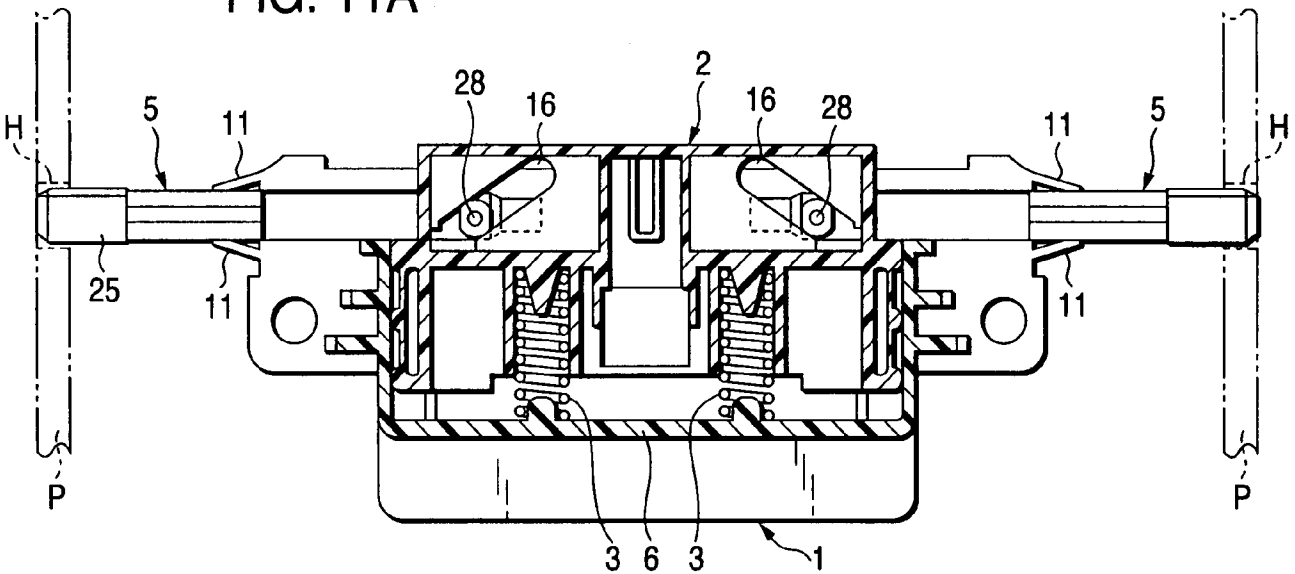
FIG. 11A is a partially cutout front view showing a state in which a forward end portion of the lock arm is engaged in the lock hole on the instrument panel.
Figure 11B:
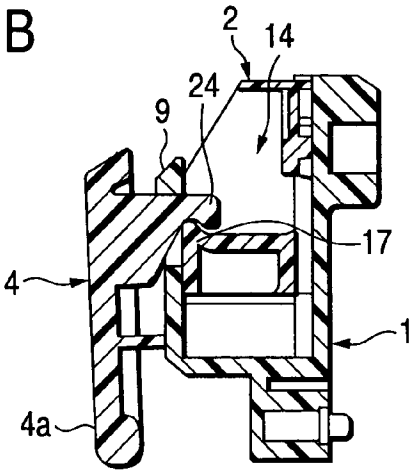
FIG. 11B is a central sectional view showing the above state.

Finally, while the forward end portion 25 of each lock arm 5 is being inserted into a through-hole (not shown) formed on the side of the glove box or the lid, the housing 1 is fixed to the front face side of the glove box or the independent lid side. Then, the side lock device can be put into actual use. When the operation lever 4 is not operated being oscillated, the pair of right and left lock arms 5 are protruded to engage with lock holes H on instrument panel P as shown in FIG. 11. Therefore, the glove box itself and the independent lid can be locked in a closed state.

Figure 12A:
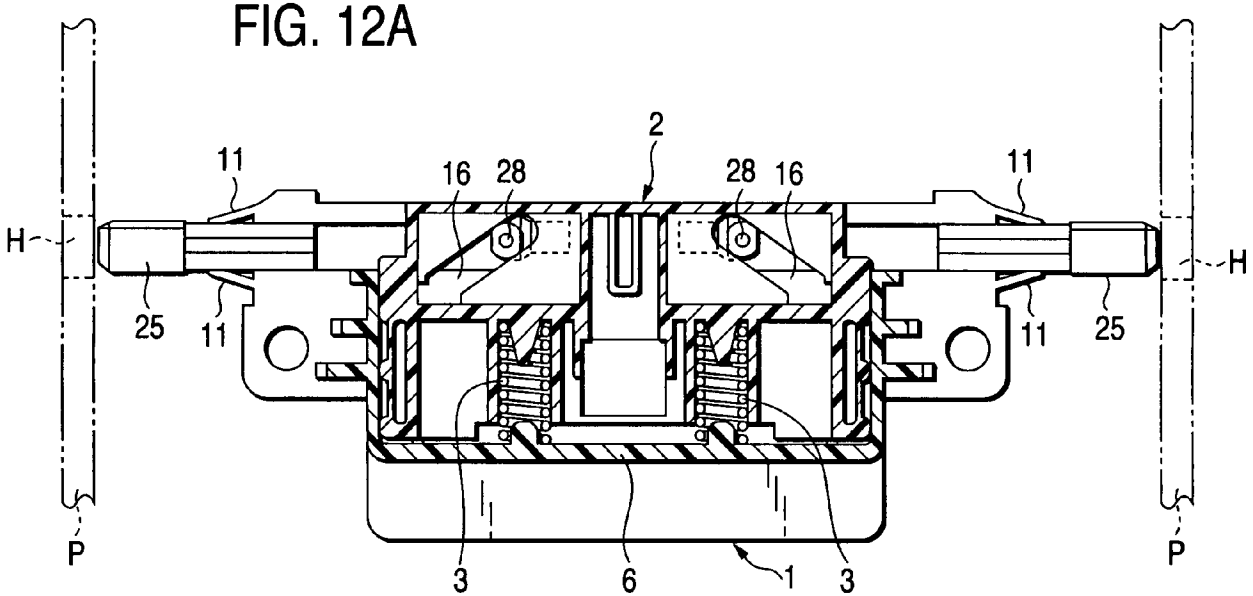
FIG. 12A is a partially cutout front view showing a state in which a forward end portion of the lock arm is retracted from the lock hole on the instrument panel.
Figure 12B:
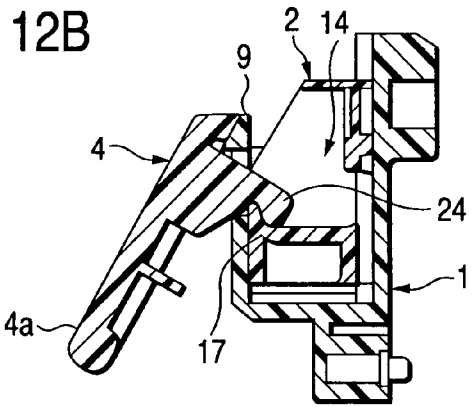
FIG. 12B is a central sectional view showing the above state.

In the case of releasing the above locking condition, operation is performed as follows. This time, while an operator is holding the operating portion 4*a* of the operation lever 4, the operator pulls up the operation lever 4. Then, the pushing pawl 24 of the operation lever 4 pushes the evaginating portion 17 of the hollow 14 of the slider 2 downward, and the slider 2 is moved downward against the pushing force of the compression coil spring 3. In accordance with the movement of the slider 2, by the action of the long cam hole 16 having the reverse-V-shape, the pins 28 of the pair of right and left lock arms 5 are moved to the inner end side of the long cam hole 16. Therefore, as shown in FIG. 12, the forward end portion 25 of each lock arm 5 is disengaged from lock hole H on instrument panel P. Therefore, the glove box itself or the independent lid can be allowed to move to the open direction.

Figure 13:
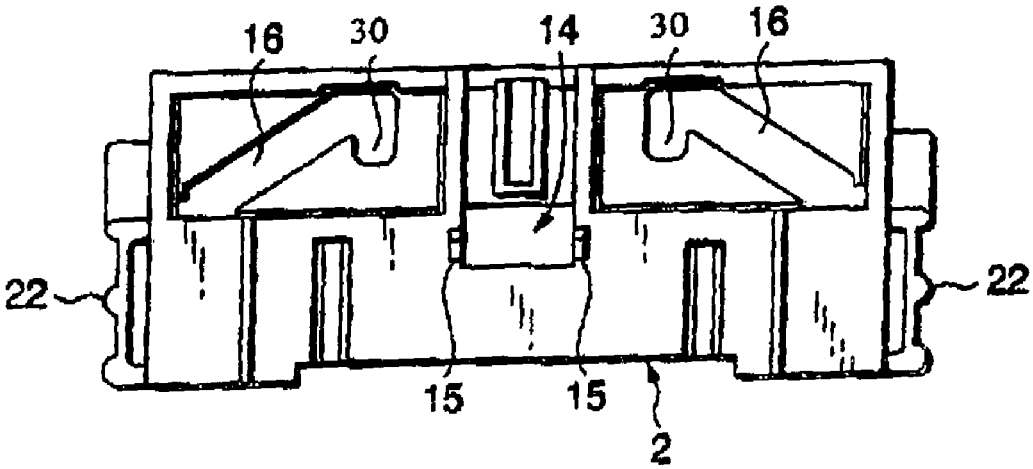
FIG. 13 is a front view showing a slider provided for the side lock device of the second embodiment.

Next, a side lock device according to a second embodiment will be explained below. From the essential viewpoint, the constitution of the side lock device of the second embodiment is made on the assumption of the first embodiment described above, however, only different points are described as follows. As shown in FIG. 13, the turning portions 30, which are parallel with the moving direction of the slider 2, are formed on the inner end side of the pair of long holes 16 having a reverse-V-shape. When the pin 28 of each lock arm 5 is engaged with the turning portion 30, the lock arm 5 can be maintained in the state of being retracted.

Accordingly, in this second embodiment, the lock arm 5 can be maintained in the state of being retracted in the normal use range of the operation lever 4. Therefore, the side lock device can be easily assembled to the glove box itself or the independent lid side, and further the profile can be made compact. In the case of releasing the state of drawing the lock arm 5 which is retracted, the operator may a little pull up the operation lever 4 and draw the lock arm 5 outside. However, when a spring is arranged between the lock arms 5, only when the operation lever 4 is pulled up, the lock arms 5 can be automatically retracted by a pushing force of the spring.

Figure 14:
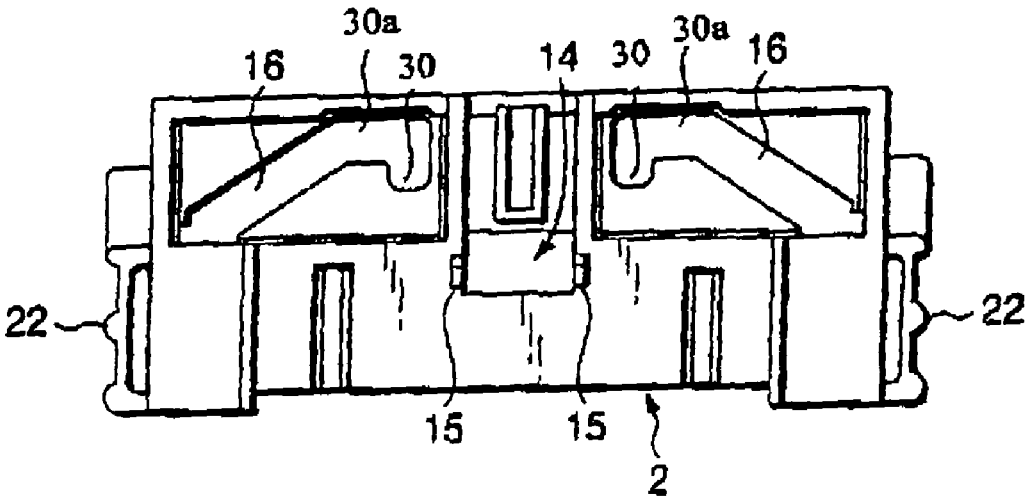
FIG. 14 is a front view showing a variation of the slider provided for the side lock device of the second embodiment.

In this case, when the turning portion 30 is given a portion 30*a*, which is perpendicular to the moving direction of the slider 2, as shown in FIG. 14, the lock arm 5 can be drawn to the housing 1 side more than the normal use range of the operation lever 4. Therefore, the side lock device can be easily assembled to the glove box itself or the independent lid side, and further the profile can be made more compact.

As described above, when the above constitution is adopted in the present invention, the slider is moved in the housing along the front face of the opening and closing body. Therefore, compared with the conventional rotary system in which the rotary body is rotated, the size and volume of the side lock device itself can be reduced.

What is claimed is:

1. A side lock device for attaching a first member to a second member to be openable, the side lock device comprising:

a pair of lock arms;

a housing which holds the lock arms movably, said housing comprising:

a main body comprising an upper surface and a front surface;

a base body, extending from said main body, said base body comprising a pair of sidewalls and a front wall, said pair of side walls extending perpendicularly from the front surface of the main body and said front wall being disposed parallel to the front surface of the main body;

a housing cavity disposed between said main body and said base body, within a space between the sidewalls of said base body; and holding grooves disposed within said main body for receiving the lock arms;

a slider comprising holes which engage with the lock arms and urge the lock arms to protrude and retract linearly, the slider disposed in the housing cavity;

an elastic member which elastically urges the slider toward a predetermined direction; and a stopper protrusion formed on a side of the slider, and projecting outwardly from the side of said slider, to prevent said slider from vertically detaching from said housing, wherein, when the slider is operated against the elastic member, the lock arms are retracted, wherein the holes engage with protrusions of the lock arms and comprise a reverse-V shape, wherein openings are formed on both side surfaces of the slider to continue to outer ends of the holes, the openings including cutouts in a wall of the slider on which the holes arc formed, the cutouts extending from the holes to side walls extending from the wall of the slider, the openings respectively communicating with the holes so as to allow the protrusions of the lock arms to be inserted into the holes from the side surfaces of the slider through the openings, and the openings aligning with the holding grooves when the slider is assembled into the housing, wherein the openings are open during a process of assembling the slider into the housing, and wherein end faces of the openings, through which the lock arms pass, are closed by the housing when the slider has been assembled into the housing.

2. The side lock device according to claim 1, wherein parallel portions are formed at the outer ends of the holes, respectively, to be parallel to a moving direction of the slider, and wherein each of the side surfaces of the parallel portions faces to each of openings.

3. The side lock device according to claim 2, wherein each of lower walls of the parallel portions is disposed in a position comprising at least one of perpendicular to the moving direction of the slider and inclined in a direction opposite to an inclination direction of the reverse-V shape.

4. The side lock device according to claim 1, further comprising:

an operation lever which operates the slider, wherein the operation lever comprises:

a fulcrum portion axially supported by the housing so that the operation lever is swingable;

an operation portion which swings the operation lever; and a pushing pawl which moves the slider against the elastic urging force, and wherein the slider comprises an evagination portion evaginating upwardly and abutting against the pushing pawl.

5. The side lock device according to claim 1, wherein turning portions to which the protrusions of the lock arms are fitted are formed at inner ends of the holes.

6. The side lock device according to claim 3, wherein each of the turning portions comprises a perpendicular portion, which is perpendicular to a moving direction of the slider.

7. The side lock device according to claim 1, wherein each of the lock arms comprises an other protrusion on an opposite side to the protrusions of the lock arms, and wherein the housing comprises recesses that engage with the other protrusions of the lock arms.

8. The side lock device according to claim 1, wherein said stopper protrusion comprises an engagement portion for engaging a window formed in a side of said housing.

9. A slide lock system comprising:

a first member;

a second member; and a side lock device which attaches the first member to the second member to be openable, wherein the side lock device comprises:

a pair of lock arms;

a housing which holds the lock arms movably, said housing comprising:

a main body comprising an upper surface and a front surface;

a base body, extending from said main body, said base body comprising a pair of sidewalls and a front wall, said pair of side walls extending perpendicularly from the front surface of the main body and said front wall being disposed parallel to the front surface of the main body;

a housing cavity disposed between said main body and said base body, within a space between the sidewalls of said base body; and holding grooves disposed within said main body for receiving the lock arms;

a slider defining inclining holes which engage with the lock arms to insert and retract the lock arms linearly into and from lock holes formed in the second member, the slider being disposed in the housing;

an elastic member which elastically urges the slider toward a predetermined direction; and a stopper protrusion formed on a side of the slider, and projecting outwardly from the side of said slider, to prevent said slider from vertically detaching from said housing, wherein, when the slider is moved along with a front surface of the first member against an elastic urging force of the elastic member, the lock arms are retracted from the lock holes, wherein the holes engage with protrusions of the lock arms and comprise a reverse-V shape, wherein openings are formed on both side surfaces of the slider to continue to outer ends of the holes, the openings including cutouts in a wall of the slider on which the holes are formed, the cutouts extending from the holes to side walls extending from the wall of the slider, the openings respectively communicating with the holes so as to allow the protrusions of the lock arms to be inserted into the holes from the side surfaces of the slider through the openings, and the openings aligning with the holding grooves when the slider is assembled into the housing, wherein the openings are open during a process of assembling the slider into the housing, and wherein end faces of the openings, through which the lock arms pass, are closed by the housing when the slider has been assembled into the housing.

10. The side lock system according to claim 9, wherein said stopper protrusion Comprises an, engagement portion for engaging a window formed in a side of said housing.

11. A side lock device for attaching a first member to a second member to be openable, the side lock device comprising:

a pair of lock arms;

a housing which holds the lock arms movably, said housing comprising:

a main body comprising an upper surface and a front surface;

a base body, extending from said main body, said base body comprising a pair of sidewalls and a front wall, said pair of side walls extending perpendicularly from the front surface of the main body and said front wall being disposed parallel to the front surface of the main body;

a housing cavity disposed between said main body and said base body, within a space between the sidewalls of said base body; and holding grooves disposed within said main body for receiving the locking arms;

a slider comprising holes which engage with the lock arms and urge the lock arms to protrude and retract linearly, the slider disposed in the housing cavity;

an elastic member which elastically urges the slider toward a predetermined direction, wherein said elastic member is in direct contact with said slider; and a stopper protrusion formed on a side of the slider, and projecting outwardly from the side of said slider, to prevent said slider from vertically detaching from said housing, wherein, when the slider is operated against the elastic member, the lock arms are retracted, wherein the holes engage with protrusions of the lock arms and comprise a reverse-V shape, wherein openings are formed on both side surfaces of the slider to continue to outer ends of the holes, the openings including cutouts in a wall of the slider on which the holes are formed, the cutouts extending from the holes to side walls extending from the wall of the slider, the openings respectively communicating with the holes so as to allow the protrusions of the lock arms to be inserted into the holes from the side surfaces of the slider through the openings, and the openings aligning with the holding grooves when the slider is assembled into the housing, wherein the openings are open during a process of assembling the slider into the housing, and wherein end faces of the openings, through which the lock arms pass, are closed by the housing when the slider has been assembled into the housing.

12. The side lock device according to claim 11, wherein parallel portions are formed at the outer ends of the holes, respectively, to be parallel to a moving direction of the slider, and wherein each of the side surfaces of the parallel portions faces to each of openings.

13. The side lock device according to claim 12, wherein each of lower walls of the parallel portions is disposed in a position comprising at least one of perpendicular to the moving direction of the slider and inclined in a direction opposite to an inclination direction of the reverse-V shape.

14. The side lock device according to claim 11, further comprising:

an operation lever which operates the slider, wherein the operation lever comprises:

a fulcrum portion axially supported by the housing so that the operation lever is swingable;

an operation portion which swings the operation lever; and a pushing pawl which moves the slider against the elastic urging force, and wherein the slider comprises an evagination portion evaginating upwardly and abutting against the pushing pawl.

15. The side lock device according to claim 11, wherein turning portions to which the protrusions of the lock arms are fitted are formed at inner ends of the holes.

16. The side lock device according to claim 15, wherein each of the turning portions comprises a perpendicular portion, which is perpendicular to a moving direction of the slider.

17. The side lock device according to claim 11, wherein each of the lock arms comprises an other protrusion on an opposite side to the protrusions of the lock arms, and wherein the housing comprises recesses that engage with the other protrusions of the lock arms.

18. A slide lock system comprising:

a first member;

a second member; and a side lock device which attaches the first member to the second member to be openable, wherein the side lock device comprises:

a pair of lock arms, each of said lock arms comprising slide grooves;

a housing which holds the lock arms movably, said housing comprising a pair of holding grooves, each of said holding grooves comprising upper and lower edges, wherein said slide grooves engage with said upper and lower edges, respectively, and said housing comprising:

a main body comprising an upper surface and a front surface;

a base body, extending from said main body, said base body comprising a pair of sidewalls and a front wall, said pair of side walls extending perpendicularly from the front surface of the main body and said front wall being disposed parallel to the front surface of the main body; and a housing cavity disposed between said main body and said base body, within a space between the sidewalls of said base body;

a slider defining inclining holes which engage with the lock, arms to insert and retract linearly the lock arms into and from lock holes formed in the second member, the slider being disposed in the housing;

an elastic member which elastically urges the slider toward a predetermined direction, wherein said elastic member is in direct contact with said slider, and a stopper protrusion formed on a side of the slider, and projecting outwardly from the side of said slider, to prevent said slider from vertically detaching from said housing, wherein, when the slider is moved along with a front surface of the first member against an elastic urging force of the elastic member, the lock arms are retracted from the lock holes, wherein openings are formed on both side surfaces of the slider to continue to outer ends of the holes, the openings including cutouts in a wall of the slider on which the holes are formed, the cutouts extending from the holes to side walls extending from the wall of the slider, the openings respectively communicating with the holes so as to allow the lock arms to be inserted into the holes from the side surfaces of the slider through the openings, and the openings aligning with the holding grooves when the slider is assembled into the housing, and wherein the holes comprise a reverse-V shape.

19. A side lock device for attaching a first member to a second member to be openable, the side lock device comprising:

a pair of lock arms, each of said lock arms comprising slide grooves;

a housing which holds the lock arms movably, said housing comprising:

a main body comprising an upper surface and a front surface;

a base body, extending from said main body, said base body having a pair of sidewalls and a front wall, said pair of side walls extending perpendicularly from the front surface of the main body and said front wall being disposed parallel to the front surface of the main body;

a housing cavity disposed between said main body and said base body, within a space between the sidewalls of said base body; and a pair of holding grooves, each of said holding grooves comprising upper and lower edges, wherein said slide grooves engage with said upper and lower edges, respectively;

a slider comprising holes which engage with the lock arms and urge the lock arms to protrude and retract linearly the slider disposed in the housing cavity;

an elastic member which elastically urges the slider toward a predetermined direction; and a stopper protrusion formed on a side of the slider, and projecting outwardly from the side of said slider, to prevent said slider from vertically detaching from said housing, wherein, when the slider is operated against the elastic member, the lock arms are retracted, and wherein openings are formed on both side surfaces of the slider to continue to outer ends of the holes, the openings including cutouts in a wall of the slider on which the holes are formed, the cutouts extending from the holes to side walls extending from the wall of the slider, the openings respectively communicating with the holes so as to allow the lock arms to be inserted into the holes from the side surfaces of the slider through the openings, and the openings aligning with the holding grooves when the slider is assembled into the housing.

20. A side lock device for attaching a first member to a second member to be openable, the side lock device comprising:

a pair of lock arms, each of said lock arms comprising slide grooves;

a housing which holds the lock arms movably, said housing comprising:

a main body comprising an upper surface and a front surface;

a base body, extending from said main body, said base body comprising a pair of sidewalls and a front wall, said pair of side walls extending perpendicularly from the front surface of the main body and said front wall being disposed parallel to the front surface of the main body; and a housing cavity disposed between said main body and said base body, within a space between the sidewalls of said base body; and a pair of holding grooves, each of said holding grooves comprising upper and lower edges, wherein said slide grooves engage with said upper and lower edges, respectively;

a slider comprising holes, which engage with the lock arms and urge the lock arms to protrude and retract linearly, the slider disposed in the housing cavity;

an elastic member which elastically urges the slider toward a predetermined direction, wherein said elastic member is in direct contact with said slider; and a stopper protrusion formed on a side of the slider, and projecting outwardly from the side of said slider, to prevent said slider from vertically detaching from said housing, wherein, when the slider is operated against the elastic member, the lock arms are retracted, wherein the holes comprise a reverse-V shape, and wherein openings are formed on both side surfaces of the slider to continue to outer ends of the holes, the openings including cutouts in a wall of the slider on which the holes are formed, the cutouts extending from the holes to side walls extending from the wall of the slider, and the openings respectively communicating with the holes so as to allow the lock arms to be inserted into the holes from the side surfaces of the slider through the openings, the openings aligning with the holding grooves when the slider is assembled into the housing.

* * * * *